US005697562A

United States Patent [19]

Leblond

[11] Patent Number: 5,697,562

[45] Date of Patent: Dec. 16, 1997

[54] ROCK CRUSHER

[76] Inventor: Michel Leblond, 84 Rue Veniot, Edmunston, New Brunswick, Canada, E3V 1L4

[21] Appl. No.: 422,927

[22] Filed: Apr. 17, 1995

Related U.S. Application Data

[63] Continuation-in-part of Ser. No. 107,116, Aug. 17, 1993, abandoned.

[51] Int. Cl.[6] ..... B02C 13/20; B02C 13/282; B02C 18/16; B02C 21/02

[52] U.S. Cl. ..... 241/101.74; 241/101.76; 241/187; 241/191; 241/197; 241/235; 241/239; 241/242; 241/282.2; 241/285.2; 241/294; 241/300

[58] Field of Search ..... 241/101.75, 101.76, 241/158, 187, 191, 197, 235, 236, 239, 242, 282.1, 282.2, 286, 285.2, 292.1, 293, 294, 300, 101.74

[56] References Cited

U.S. PATENT DOCUMENTS

| | | | |
|---|---|---|---|
| 758,302 | 4/1904 | Decker | 241/285.2 |
| 1,462,096 | 7/1923 | Wiertz . | |
| 1,826,157 | 10/1931 | Turucz | 241/158 X |
| 2,027,840 | 1/1936 | Rodin . | |
| 2,442,492 | 6/1948 | Hassler et al. | 241/294 X |
| 2,447,399 | 8/1948 | Dey | 55/51 |
| 2,618,438 | 11/1952 | Chrystal | 241/81 |
| 3,194,288 | 7/1965 | Dodgen et al. | 241/158 X |
| 3,540,534 | 11/1970 | Rhoads | 171/63 |
| 3,952,811 | 4/1976 | Carre | 172/45 |
| 4,205,799 | 6/1980 | Brewer | 241/243 |
| 4,298,170 | 11/1981 | Snavely | 241/242 X |
| 4,417,627 | 11/1983 | Willibald | 172/45 |
| 4,449,673 | 5/1984 | Cameron | 241/186 R |
| 4,848,682 | 7/1989 | Scheier | 241/190 |
| 5,025,995 | 6/1991 | Smith | 241/235 X |
| 5,060,875 | 10/1991 | McBride | 241/242 |

FOREIGN PATENT DOCUMENTS

| | | | |
|---|---|---|---|
| 503198 | 9/1992 | European Pat. Off. | 241/294 |
| 395110 | 1/1974 | U.S.S.R. | 241/235 |

*Primary Examiner*—Timothy V. Eley
*Attorney, Agent, or Firm*—Antonelli, Terry, Stout & Kraus, LLP

[57] ABSTRACT

A rock crusher comprises a pair of rotors spaced apart to define a throat therebetween and driven in opposite directions. Impactor bars on the rotors crush rock that is delivered to the rotors and passes the broken rock fragments through the throat. The rock crusher may be conveniently provided in a harvesting vehicle such as a potato harvester to crush rock that has been picked up with and separated from the crop. The rocks can be crushed to a sufficiently small size that they may be conveniently returned to the field surface, and thus the arrangement avoids the trouble and expense that would otherwise be entailed in collecting and disposing of the separated rock.

30 Claims, 5 Drawing Sheets

ROCK CRUSHER

CROSS-REFERENCE TO RELATED APPLICATION

This is a continuation in part of my U.S. patent application Ser. No. 08/107,116 filed Aug. 17th, 1993 now abandoned.

BACKGROUND OF INVENTION (a) Field of the Invention

This invention relates to a new or improved rock crusher, particularly, but not exclusively to a rock crusher suitable for incorporation in an agricultural harvesting vehicle such as a potato harvester to crush rock which has been taken up from the field surface along with the crop.

(b) Description of the Prior Art

In potato harvesters the rocks separated from the crop, should preferably be removed rather than simply being returned to the field. Hitherto this has entailed collecting the rocks in a box on the harvester and periodically removing them, by dumping them in a pile in the field for subsequent disposal by another vehicle. This method is clearly inefficient, and furthermore since it increases compaction of the soil because of the increased traffic necessary for collection and disposal of the piles of rock, in the long run it will decrease the productivity of the land. U.S. Pat. No. 4,417,627 shows an apparatus that includes a work shaft having prongs and a rotatably driven drum on which flail-like parts are mounted whereby rocks lifted and pre-crushed by the rotary motion of prongs on the work shaft are broken by impact by the flail-like parts of the rotating drum.

The prior arrangements are designed as separate machines to crush rocks in an agricultural field. The high speed impact breaking of rocks on the ground employed by prior art machines also breaks the structure of the soil. Use of a rock crusher mounted on a harvester in stony potato fields is more desirable since crushing of rocks can be achieved above the ground and in the same operation as harvesting.

SUMMARY OF THE INVENTION

The present invention provides a rock crusher comprising: a frame; bearing means carried in said frame and mounting a pair of rotors for rotation about parallel axes and at a predetermined spacing from each other to define between them a throat; each said rotor carrying a plurality of radially projecting longitudinally extending impactors, the impactors of each rotor being angularly spaced apart providing clearance therebetween; drive means connected to rotate said rotors in timed synchronous fashion but in opposite directions so that the impactors of the opposed rotors pass in pairs through said throat at the same time; and means for directing rock into said throat to be crushed and passed through said throat by said rotating impactors.

The drive means is preferably in the form of a pair of flexible reinforced rubber double-sided tooth belts each of which is trained in a continuous loop and contacts toothed wheels or pinions that are keyed to the respective rotors, the path of the belts being such as to rotate the rotors in opposite directions.

The impactors may be in the form of breaker bars detachably connected as by welding on mounting plates that are releasably secured to the rotor by recessed cap screws. However, preferably the breaker bars are formed integral with the mounting plates in unitary structures. There preferably are interengaging formations such as complementary ribs and grooves between each mounting plate and the rotor to absorb impact loads thus preventing damage to the cap screws. The mounting plates altogether preferably enclose the entire periphery of the rotors so that the surface of the latter is entirely shielded from abrasive wear.

Replaceable wear plates of impact and abrasion resistant steel are preferably provided on the internal surfaces of the housing of the crusher at the locations most subject to wear, i.e. on the end walls adjacent to the ends of the rotors.

The rock crusher can be operated from any convenient power source, e.g. gasoline or diesel engines or hydraulic or electric motors. While in stationary installations electric drive motors may be suitable, in mobile applications, such as in crop harvesting vehicles it will be more convenient to power the rock crusher from either a mechanical or fluid power take-off from the vehicles main systems, or by means of a separate engine.

DESCRIPTION OF THE DRAWINGS

The invention will further be described, by way of example only, with reference to the accompanying drawings in which.

DESCRIPTION OF THE PREFERRED EMBODIMENTS

Figure 7:
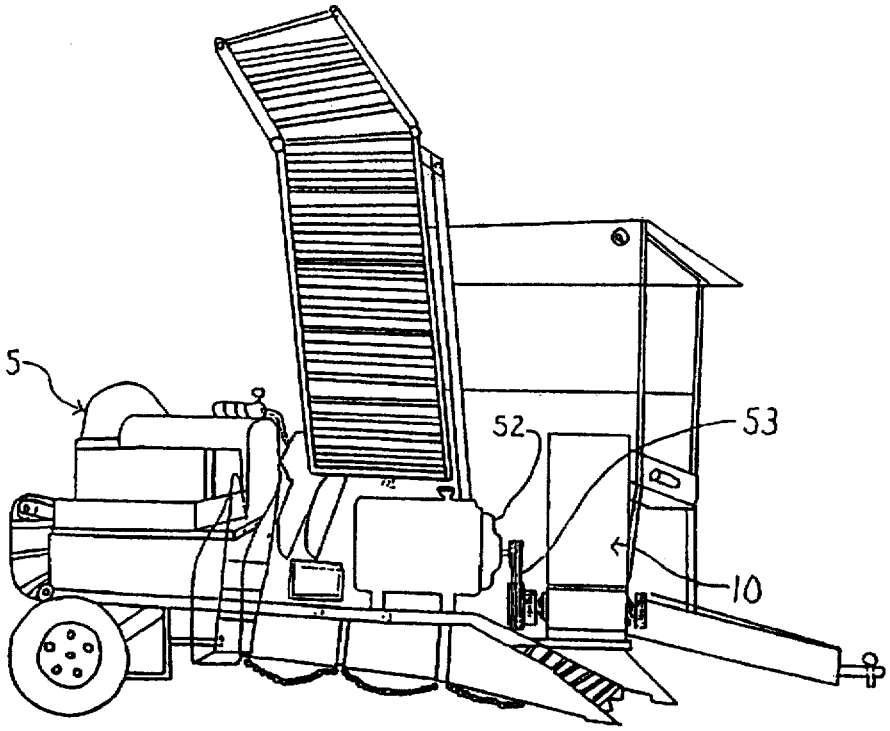
FIG. 7 is a generally schematic view illustrating the rock crusher as provided in a potato harvester.

As seen in FIG. 7, a potato harvesting machine 5 of generally known construction includes a rock crusher 10 mounted thereon to receive rocks and other debris which the harvester separates from potatoes that are lifted from the surface of the field. As will be described, the rock crusher 10 fractures and fragments these rocks, returning them to the field surface where they have beneficial effects on the quality of the soil.

Figure 1:
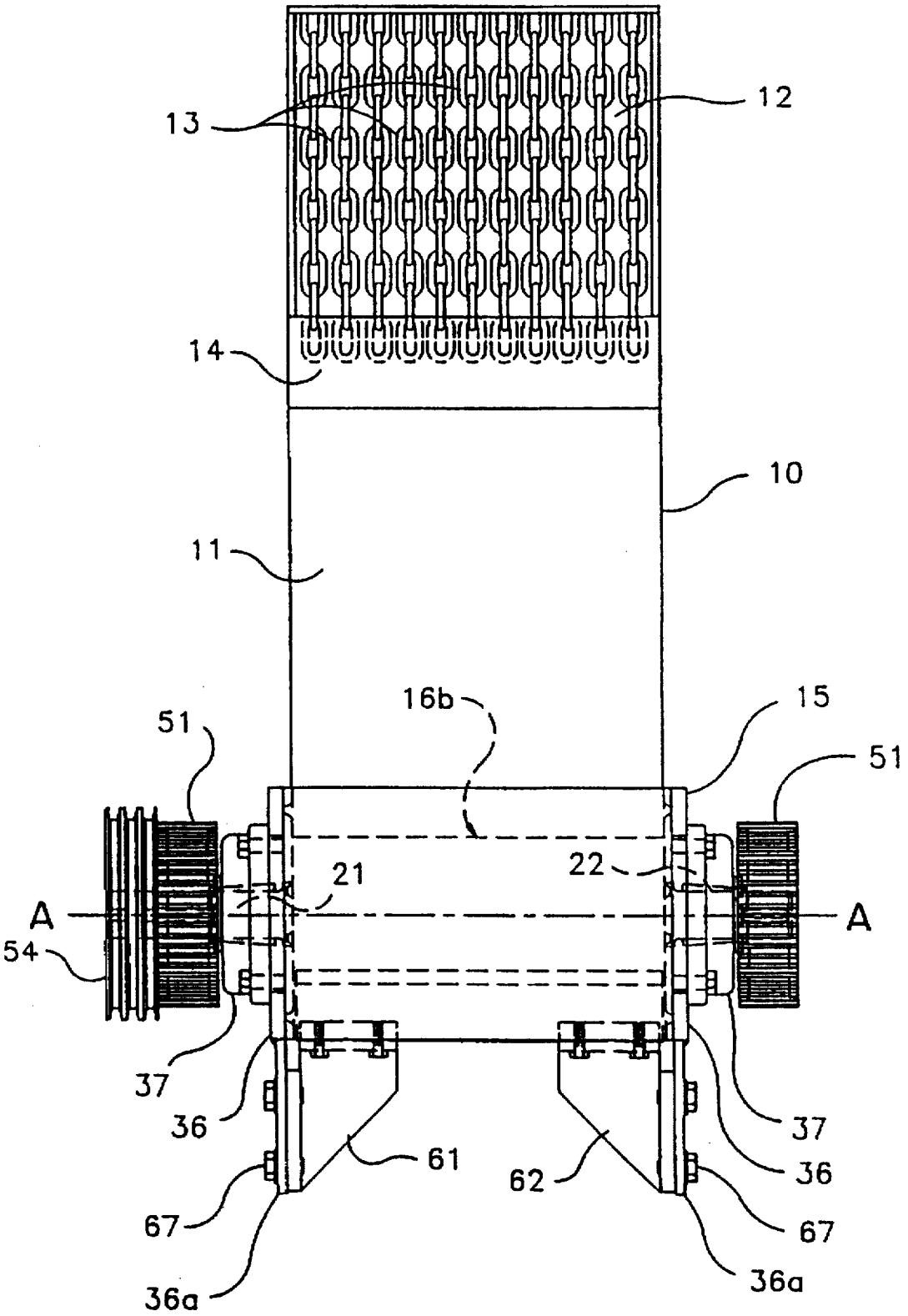
FIG. 1 is a somewhat schematic front elevation of a rock crusher in accordance with the invention.
Figure 2:
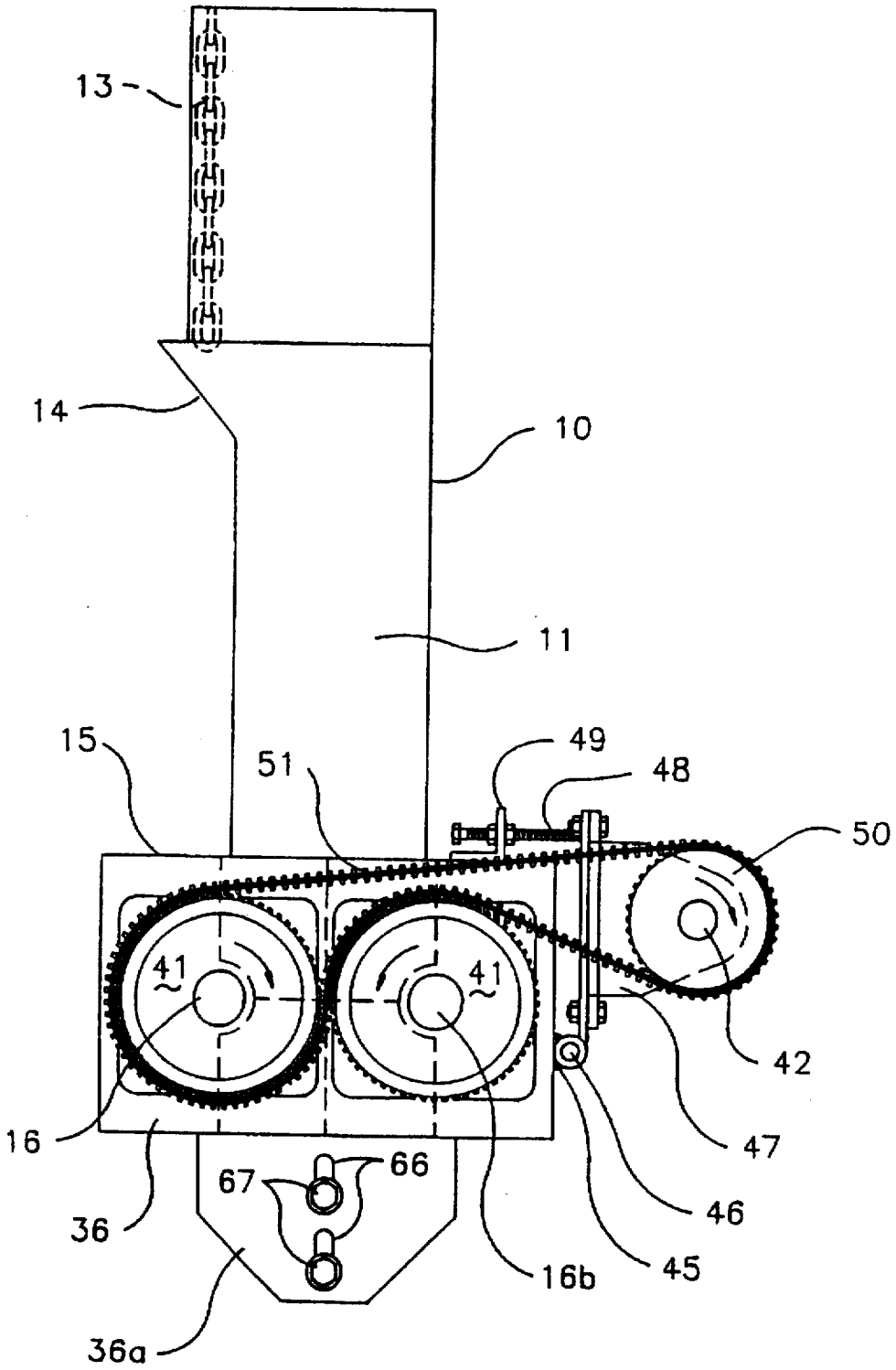
FIG. 2 is a side view corresponding to FIG. 1.
Figure 3:
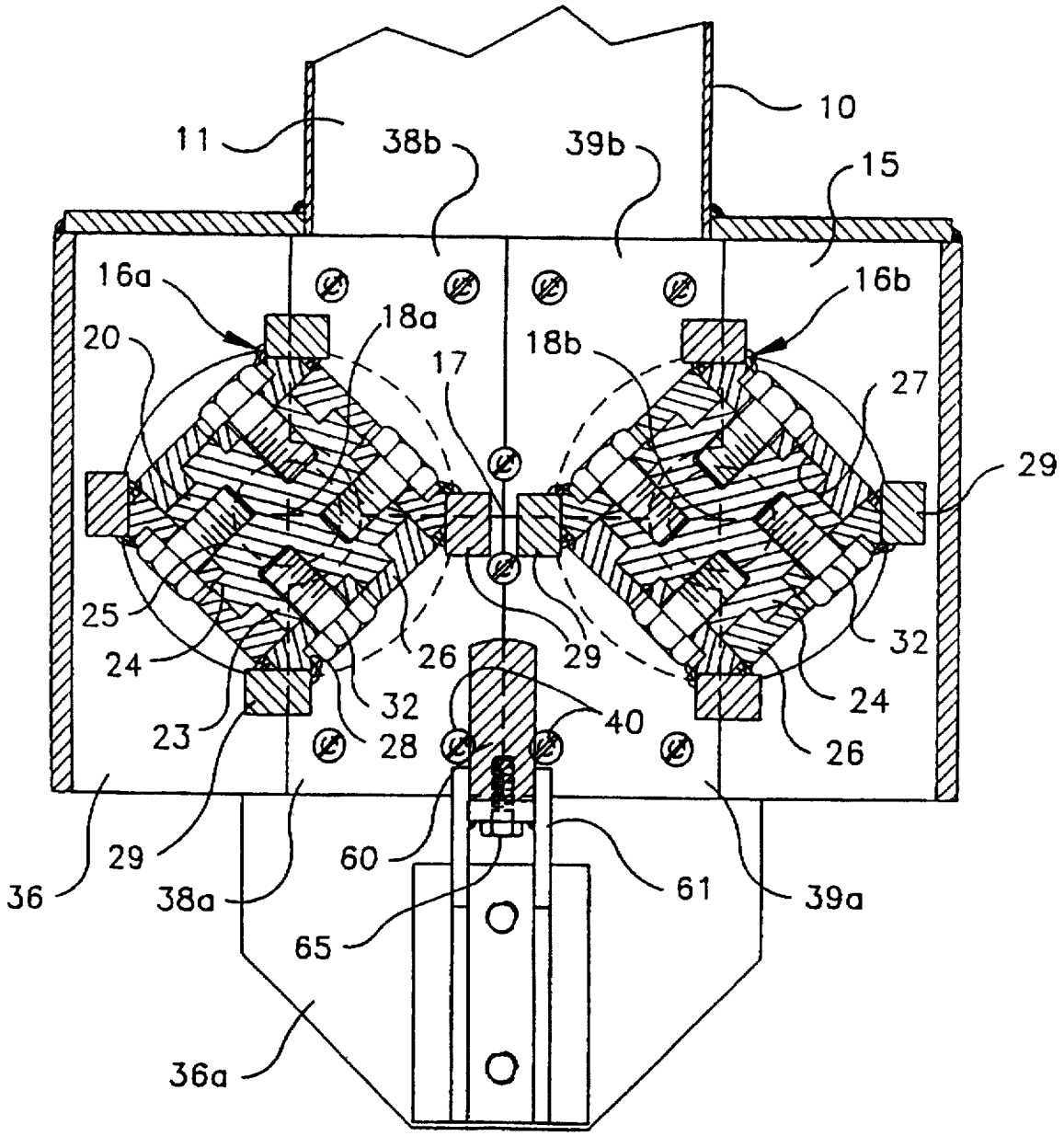
FIG. 3 is an enlarged fragmentary sectional view taken on the line A—A in FIG. 1.

The rock crusher as seen in FIGS. 1 to 3 comprising a housing generally indicated at 10 in the form of a steel casing defining a vertically arranged rectangular passage 11 the upper end of one major vertical side thereof defining a large rectangular inlet opening 12 which is curtained by a series of closely spaced suspended chain lengths 13 the lower ends of which extend below an angled lip section 14 of the inlet opening.

Figure 4:
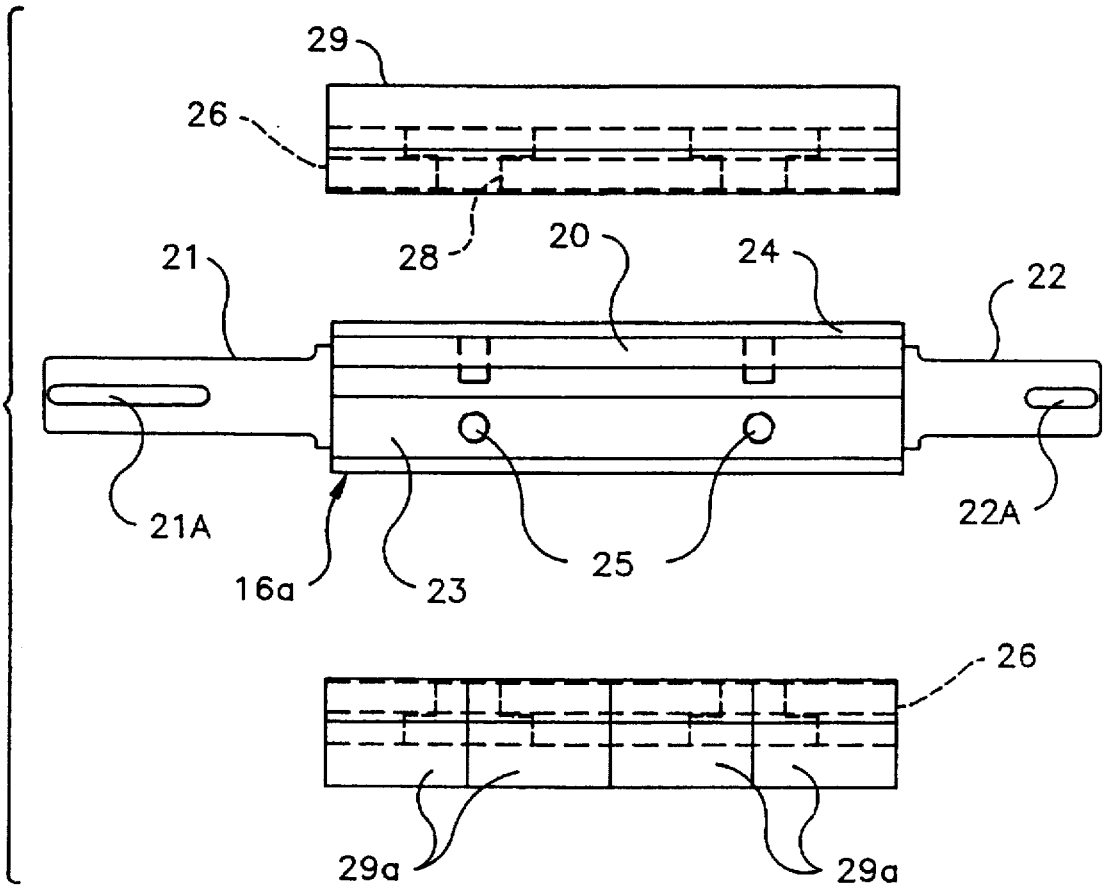
FIG. 4 is an exploded front elevational view of a rotor of the rock crusher shown with impactor bars detached from the rotor.
Figure 5:
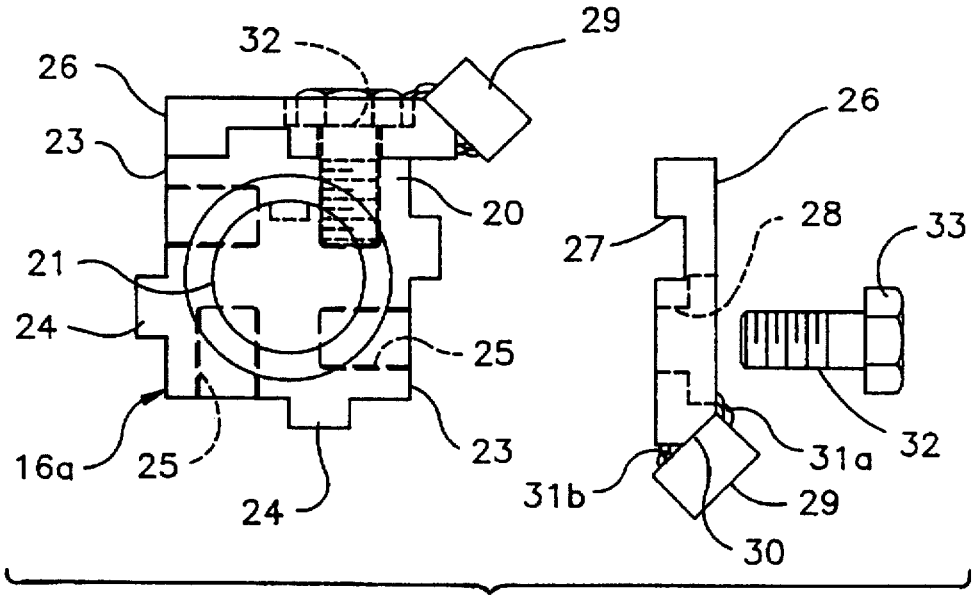
FIG. 5 is a partially exploded end view of the rotor and two impact or elements.

At the lower end of the housing is an enlarged crushing section 15 (see FIG. 3), in which are arranged two parallel horizontal rotors **16*a*, 16*b* defining between them a narrow throat 17**, the construction of the rotors being more clearly illustrated in FIGS. 3 through 5.

As best seen in FIG. 4, each rotor comprises a unitary steel shaft having a central section 20 of generally square profile and reduced end sections 21, 22 of cylindrical form, each having an axially extending keyway, **21*a*, 22*a* respectively, and the end section 21 of the rotor 16*a* being substantially longer than section 22. The end sections 21, 22 of the rotor 16***b* are substantially equal. The profile of the central section 20 of each rotor is most clearly shown in FIG. 5 as comprising four flat identical elongate faces 23 arranged in a square pattern, each face having a projecting rectangular rib 24 extending throughout the full length of the central section 20. As shown, the rib is offset towards one edge of the associated face 23, this edge being referred to as the trailing edge, considered in respect to the direction of rotation of the rotors as seen in FIG. 3. Additionally, a pair of axially spaced screwthreaded bores 25 open from each of the faces 23, the bores being symmetrically positioned in each face and separated by a spacing that is approximately equal to half the length of the rotor central section 20. The bores 25 are positioned between the leading edge of the face 23 and the rib 24.

Each face 23 of the rotor is covered in use by a detachable rectangular mounting plate 26 which is formed with a longitudinally extending groove 27 complementary to the rib 24. The plate 26 has an area that completely covers the corresponding face 23 of the rotor. As clearly shown in FIGS. 3 and 5 the rear edge (considered in the direction of rotation) of the plate 26 coincides with the rear edge of the face 23 whereas the forward edge of the plate 26 projects forwardly of the forward edge of the face 23 and overlaps the rear edge of the preceding plate 26. The plate 26 furthermore has a pair of countersunk bores 28 positioned to register with the screwthreaded bores 25 in the rotor, and at the leading longitudinal edge the mounting plate carries an impactor bar 29. As shown, the impact bar 29 is of rectangular profile and is obliquely arranged, being seated on an angled surface 30 at the leading edge of the mounting plate and affixed thereto by welding beads 31*a*, 31*b*.

As seen in FIG. 3 and 5, the mounting plates 26 are releasably attached to the rotors 16*a*, 16*b* by threaded capscrews 32 passed through the bores 28 and engaged in the screwthreaded bores 25, the heads 33 of the capscrews being received in the countersunk portion of the bores 28 so that they do not project significantly above the outer surface of the mounting plates 26. The arrangement of the ribs 24 on the rotor cooperating with the complementary grooves 27 in the mounting plates 26 provide a large area surface to absorb and transmit impact loads between the impact bars 29 and the rotors 16*a*, 16*b* so that these loads are safely absorbed. Furthermore it will be noted that these interengaging formations serve to shield the capscrews 32 from any shear loads so that they are loaded essentially only in tension.

As will be understood from a consideration of the foregoing description in conjunction with the drawings, each mounting plate 26 extends over the entire length of the square central section 20 of the rotor, this length corresponding to the length dimension of the crushing section 15 of the machine. It would of course be possible to provide a mounting plate that is longitudinally divided into a number of individual sections (not shown), and in that event additional threaded holes 25, cap screws 32 and countersunk bores are necessary to ensure that each section is securely attached to the rotor.

The impactor bars 29 extend longitudinally over at least the major part of the length of the central section 20 of the rotor. The impactor bar 29 shown at the upper side of FIG. 4 is continuous over the full length of the mounting plate 26. In the alternative arrangement shown in the lower side of FIG. 4, the impactor bar may be fabricated as a series of shorter sections 29*a* arranged end-to-end and secured to the mounting plate 26 as before by welding beads 31*a*, 31*b* as seen in FIG. 5. The sections 29*a* together have a length corresponding to at least the major part of the length of the crushing section 15. As shown the impactor bar sections 29*a* are butted end-to-end, although they could be separated from each other by narrow gaps. The length of each section 29*a* can be varied widely, and preferably is not less than the radius of the impactor bar from the axis of the respective rotor 16*a*, 16*b*. In any event the impactor bar sections have a length in the longitudinal direction of the rotor that is at least three times greater than the distance of the maximum radial projection of the impactor bar beyond the base of the the mounting plate 26.

When all four mounting plates 26 are attached to the rotor central section 20, it will be seen from FIG. 3 that the surfaces of the latter are completely covered by the detachable mounting plates 26, and that each rotor is provided with four equiangularly spaced impactor bars 29. The impactor bars register with the corner edges of the central section 20 and are thus separated by a large angular clearance.

As shown in FIGS. 1, 2 and 3, each rotor is carried in end plates 36 of the crushing section 15 by means of heavy duty sealed roller bearing assemblies 37 secured to these end plates and engaged upon the cylindrical portions of the respective ends 21, 22 of the rotors 16*a*, 16*b* by means of a taper lock adapter sleeve. The rotors are thus mounted to rotate on parallel axes in the crushing section 15. On the inner side of each of the end plates 36, detachable wear plates 38*a*, 38*b*, 39*a*, 39*b* are provided extending from top to bottom of the end plates in the region between the rotational axes 18*a*, 18*b* of the rotors 16*a*, 16*b*. These wear plates are secured to the end plate 36 by countersunk screws 40.

To improve the fragmenting effect of the rock crusher, an anvil is provided immediately below the throat 17. The anvil is in the form of a rigid horizontally extending bar 60 of a suitable impact and abrasive resistant steel that is supported at its opposite ends in a pair of brackets 61, 62, each bracket forming on its upper side an upwardly open seat. Capscrews 65 extending through suitable apertures in the brackets engage in threaded bores in the underside of the anvil bar 60 and secure the ends of the latter to the associated seat. Each of the brackets 61, 62 is in turn supported on an extension 36*a* of the associated end plate 36. As seen in FIG. 2, each extension 36*a* has a pair of vertically aligned elongated slots 66 through which extend capscrews 67 engaged in threaded holes in the brackets 61, 62. By loosening the capscrews 67 the associated brackets 61, 62 are freed for adjustment vertically relative to the side plates. Upon tightening of the capscrews 67 the brackets 61, 62 and hence the anvil bar 60 are rigidly secured in fixed relation to the housing. To ensure that the anvil bar does not move from its selected position of adjustment, the confronting faces of the extension walls 36*a* and the brackets 61, 62 have complementary interengaging serrations, e.g. of a sawtooth profile (not shown).

A drive system for the rotors 16*a*, 16*b* comprises a pair of toothed pinions 41 keyed to the end portions 21, 22 of each rotor on the outboard side of the end plates 36. As seen in FIG. 2, a layshaft 42 is mounted on one side of the crushing section 15 to rotate about an axis that is parallel to those of the rotors 16*a*, 16*b* the mounting arrangement being schematically illustrated in FIG. 2. A pair of brackets 45 on the rear wall of the crushing section 15 provide pivotal mountings 46 which in turn each supports a carrier 47 that provides a bearing for one end of the layshaft 42. A threaded adjusting stud 48 carried by the upper end of each bracket 45 is axially adjustable with respect to a fixed bracket 49 on the crushing section 15.

On each end of the layshaft 42 a toothed idler pinion 50 is keyed to rotate with the shaft. A flexible transmission element in the form of a double sided toothed belt 51 passes around each idler pinion 50 and then extends in an endless loop around both of the pinions 41 in the path shown in FIG. 2.

Rotation of the rotors 16*a*, 16*b* is powered from a motor 52 (FIG. 7) coupled through a multiple belt drive 53 to a grooved pulley 54 keyed to the elongate end portion 21 of the rotor 16*a*. Alternatively the drive from the motor 52 could be applied via a grooved pulley (not shown) on the shaft 42 which in this case would be a drive shaft rather than a layshaft. It will be appreciated that operation of the motor 52 and belt drive 53 will be effective to rotate the two rotors synchronously in timed relation and in opposite directions. The drive is coupled such that the impactor or hammer bars 29 of each rotor approach the throat 17 (from the upper side as seen in FIG. 3) in synchronism.

In operation, with the rotors being driven (in the directions indicated by the arrows in FIG. 2) at an appropriate speed of rotation, rocks delivered from the harvester or other vehicle to the inlet opening 12 fall through the vertical passage 11 of the housing towards the throat 17 and are impacted and fragmented by the rotating bars 29 as the rocks approach the throat. The use of opposed rotors with impactor bars rotating in synchronism maximizes the fracturing effect of the latter. As will be understood, the rotors 16*a*, 16*b* are driven in precisely timed synchronized relationship by means of the toothed belts 51 cooperating with the pinions 41 on the ends of the shafts. Thus as the rotors rotate, the impactor bars 29 pass in pairs through the throat 17, i.e. the opposed impactor bars 29 are swing downwardly and convergently towards the throat 17 to pass simultaneously through the plane between the rotor axes 18*a*, 18*b*. This timed relationship together with the high inertia of the rotating mass of the two rotors ensures that massive impact loadings are applied by the compactor bars to rocks delivered into the crushing section through the vertical passage 11. The fracturing effect is further enhanced by the addition of the anvil bar 60 which has the effect of reducing the maximum size of rock fragments which can pass through the rock crusher. The rocks are accordingly fractured by the bars and the rock fragments pass downwards between the rotors to be thrown from the lower end of the crusher. The chains 13 reduce the likelihood of rock fragments being ejected through the inlet 12.

The drive to the rotors can be provided in many different ways, and the motor 52 can be a prime mover such as a gasoline or diesel engine, or even an electric motor where the rock crusher is provided in a fixed location. Where the rock crusher is provided on a vehicle having a hydraulic system, then the motor 52 may conveniently be a hydraulic motor driven thereby, or by a mechanical power take off on a tractor.

As will be understood, in operation the components of the rock crusher, and in particular the rotors and associated parts are subjected to very high impact loads. It is accordingly important that these loads can safely be absorbed by the rotors themselves, their bearings, and by the drive system. Thus the toothed driving belts 51 are of a fiber reinforced rubber composition and embody a degree of resilience to absorb the impact load. Such toothed timing belts are commercially available as supplied by Dodge Engineering. It is important for the drive to the rotors to be applied from both ends since this reduces the torsional loading of the rotors and also makes it possible to deliver the driving torque through two belts. To deliver the required torque through a single belt would entail the use of a belt that would be inconveniently wide and difficult to control. In the configuration shown the drive belts 51 at opposite ends of the rotors 16*a*, 16*b* are synchronized and their loading is equalized through the idler pinions 50 and the layshaft 42. To transmit the required high driving forces, the belts 51 are relatively wide. The tension in each belt 51 is controlled and adjusted periodically by means of the associated threaded adjusting stud 48.

Figure 6:
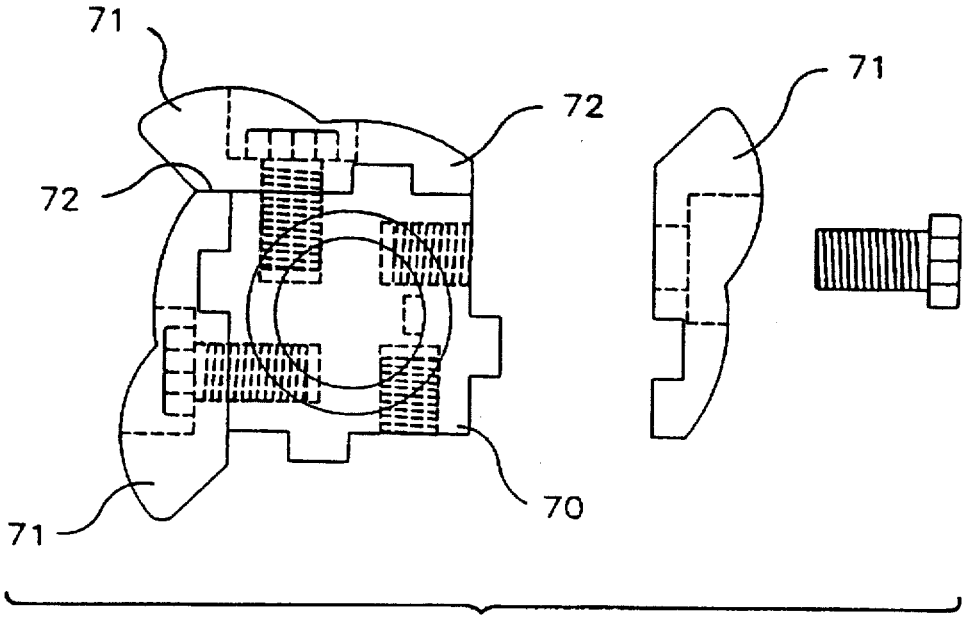
FIG. 6 is a partially exploded view showing an alternative form of rotor assembly.

An alternative rotor assembly configuration is shown in FIG. 6. The rotor body 70 in FIG. 6 is essentially identical to the body of the rotors 16*a* and 16*b* comprising a unitary steel shaft of the profile shown. However in the embodiment of FIG. 6 there are provided unitary impactors 71 which combine the function of the mounting plate 26 and impactor bars 29 of the previously described embodiment. As before, each impactor 71 completely covers the corresponding face of the rotor 70 and projects slightly forwardly therefrom contacting and covering the trailing edge 72 of the preceding impactor. The impactors 71 are secured in the same manner as the above described and are made of materials having the same characteristics. As will be understood, the unitary impactors 71 each extends longitudinally over substantially the full length of the rotor in the crushing section 15 of the machine. The impactor 71 may be continuous as shown, or may be divided longitudinally into shorter sections. In either case, a sufficient number and arrangement of fasteners such as the cap screws 32 are provided to ensure that each impactor or section thereof is securely attached to the rotor, and yet can be disassembled when necessary for repair or replacement.

All components of the rock crusher are made from suitable hard, abrasive and shock-resistant materials. Thus the housing 10 can be fabricated by welding from steel plates of suitable hardness and abrasion resistance, e.g. Scandia 400 (Trade-mark) which has a Brinell hardness of 400. The rotors 16*a*, 16*b* are unitary components formed for example from ASTM-C 1045 steel which has the appropriate strength and impact resistance for this application. The impactor bars 29 are suitably made from a low carbon work hardening impact resistant steel such as Astralloy "V" (Trade-mark) sold by Hitesi Products Inc. The wear plates 38, 39 are also formed from an impact resistant steel that is hard and highly resistant to abrasion, e.g. Astralloy "V".

As mentioned earlier, the rock crusher can be provided on a harvester such as a potato harvester to replace the rock box that was formerly provided to collect rocks picked up from the field surface along with the crop. The above described rock crusher being of compact configuration can be accommodated together with a diesel engine to drive it, in place of the rock box. The rock crusher is significantly more efficient than known rock crushers employing rotary driven hammers or flails cooperating with stationary anvils. For example the rock crusher of the present invention operates at a greater efficiency than known single rotor rock crushers in that the dual rotor design means that the major part of the weight of the rock crusher is in these moving parts where it can be utilized more effectively than in stationary anvils. Accordingly more of the energy supplied to the rock crusher is applied to impacting the rock to be crushed, and less is lost in friction. The rock crusher of the present invention is substantially lighter than a single rotor prior art rock crusher of equivalent capacity since a much greater proportion of the weight of the new rock crusher is embodied in the rotors rather than in stationary parts.

A rock crusher of a size suitable to be provided on a potato harvester machine would have a total weight of approximately 1700 pounds. This weight is inclusive of the chassis or frame carriage and a diesel engine that is capable of delivering a continuous output of 36 horsepower. The drive system is designed to rotate the rotors at a speed which will vary in the range 800 to 1200 rpm.

Many variations of the details and structure of the rock crusher will be obvious to those of ordinary skill in the art, and all such details and modifications are intended to be comprehended within the scope of the appended claims.

What is claimed is:

1. A rock crusher comprising:

a frame;

bearing means carried in said frame and mounting a pair of rotors for rotation about parallel axes and at a predetermined spacing from each other to define between them a throat that has a width and a length;

each said rotor carrying a plurality of radially projecting longitudinally extending impactors, said impactors having a longitudinally extent equal to at least a part of the length of said throat, the impactors of each rotor being angularly spaced apart providing clearance therebetween;

drive means connected to rotate said rotors in timed synchronous fashion but in opposite directions, the impactors of the opposed rotors being in register so as to pass simultaneously in pairs through a plane in said throat that extends along said axes of said rotors; and a passage for directing rock into said throat to be fractured by said rotating impactors into fragments of a size sufficiently small to pass between said rotors.

2. A rock crusher as claimed in claim 1 wherein said drive means is coupled to apply a driving torque to each end of both of said rotors.

3. A rock crusher as claimed in claim 2 wherein said driving means comprises a transmission element of flexible resilient material at opposite ends of said rotors, each said transmission element being passed in an endless loop in succession over: a first drive wheel fixed to rotate with one said rotor; a second drive wheel fixed to rotate with the other said rotor; and a third wheel that is mounted to rotate on an axis that is parallel to the axes of said rotors.

4. A rock crusher as claimed in claim 3 wherein each said transmission element comprises a flexible toothed belt and said wheels comprise toothed pinions.

5. A rock crusher as claimed in claim 4 wherein each said belt is toothed on both sides thereof one side having teeth that engage with said first drive wheel and said third wheel and the other side having teeth that engage with said second drive wheel.

6. A rock crusher as claimed in claim 2 including removable wear plates that are mounted on end walls of the frame and secured by releasable threaded fasteners.

7. A rock crusher as claimed in claim 2 wherein said drive means includes a belt driven pulley attached to one of said rotors and a motor coupled to drive said pulley.

8. A rock crusher as claimed in claim 2 wherein said drive means comprise fiber reinforced flexible rubber belts cooperating with toothed pinions on the respective opposite ends of said rotors to drive the rotors in timed synchronous manner.

9. A rock crusher according to claim 8 wherein each said belt is passed in an endless loop in succession over a first gear fixed to rotate with one said rotor, a second gear fixed to rotate with the other said rotor and a third gear fixed to rotate with one end of a common lay shaft that is mounted to rotate on an axis that is parallel to the axes of the rotors, and further including motor means coupled to apply a rotary drive to said rotors.

10. A rock crusher as claimed in claim 2 in combination with a harvester vehicle, said harvester vehicle including means for processing crop material lifted continuously from the surface of a field, said vehicle including means for separating rock from such material and delivering such separated rock to said rock crusher.

11. A rock crusher as claimed in claim 1 wherein each said impactor comprises a breaker bar of high strength impact resistant material, said impactors being detachably connected to said rotors.

12. A rock crusher as claimed in claim 6 wherein each impactor is attached to a carrier plate that in turn is adapted to be detachably connected to the rotor.

13. A rock crusher as claimed in claim 7 wherein the peripheral surface of each said rotor is substantially completely shielded from wear by the associated carrier plates.

14. A rock crusher as claimed in claim 13 wherein each rotor is of generally square cross section and is adapted to support four carrier plates arranged successively at right angles and each extending over at least a major portion of the length of the throat.

15. A rock crusher as claimed in claim 13 wherein each said impactor comprises a plurality of sections arranged end-to-end and having a combined length substantially equal to that of said throat.

16. A rock crusher as claimed in claim 12 including screwthreaded fastener means adapted to detachably connect each carrier plate to its rotor, said rotor and said carrier plates having complementary formations defining interengaging confronting surfaces that extend at least partially in the radial direction relative to the rotor axis and that function to shield said threaded fastener means from loading in shear.

17. A rock crusher as claimed in claim 16 wherein said interengaging formations comprising interengaging rib and groove means on said rotor and said carrier plate, said rib and groove means extending in the longitudinal direction of the rotor.

18. A rock crusher as claimed in claim 12 wherein each breaker bar is attached to its carrier plate by welding and is of rectangular profile and is oriented with said rectangular profile oblique to a radial plane of the associated rotor to present a leading corner in the direction of rotation.

19. A rock crusher as claimed in claim 11 wherein each impact or is formed integrally with a carrier plate that is detachably connected to the rotor.

20. A rock crusher as claimed in claim 19 wherein said carrier plates in combination substantially completely shield the peripheral surface of each rotor throughout the length of said throat.

21. A rock crusher as claimed in claim 19 wherein said rotor and said carrier plates have complementary formations defining interengaging confronting surfaces that extend at least partially in the radial direction of the rotor to transfer impact loading forces from the breaker bars to the rotor.

22. A rock crusher as claimed in claim 1 in combination with a motor driven mobile vehicle, the motor of said vehicle providing power for driving said rock crusher.

23. A rock crusher as claimed in claim 1 in combination with a vehicle that includes means for lifting surface material including rocks from the surface of a field and separating means for separating said rocks and delivering them to the rock crusher.

24. The combination of claim 23 wherein said rock crusher is adapted to be driven by a hydraulic motor coupled to a hydraulic system of said vehicle.

25. A rock crusher as claimed in claim 1 further comprising an anvil in the form of a rigid bar supported in said frame in the region immediately below and extending generally parallel to said throat said anvil being adjustable towards and away from said throat.

26. A rock crusher comprising:

a frame;

bearing means carried in said frame and mounting a pair of rotors for rotation about parallel axes and at a predetermined spacing from each other to define between them a throat;

each said rotor carrying a plurality of radially projecting longitudinally extending impactors, the impactors of each rotor being angularly spaced apart providing clearance therebetween;

drive means connected to rotate said rotors in timed synchronous fashion but in opposite directions so that the impactors of the opposed rotors pass in pairs through said throat at the same time;

said drive means comprising a transmission element of flexible resilient material at opposite ends of said rotors, each said transmission element being passed in succession over: a first drive wheel fixed to rotate with one said rotor; a second drive wheel fixed to rotate with the other said rotor; and a third wheel fixed to rotate with a respective end of a common lay shaft that is mounted to rotate on an axis that is parallel to the axes of said rotors; and means for directing rock into said throat to be crushed and passed through said throat by said rotating impactors.

27. A rock crusher as claimed in claim 26 wherein each said transmission element comprises a flexible toothed belt and said wheels comprise toothed pinions.

28. A rock crusher comprising:

a frame;

bearing means carried in said frame and mounting a pair of rotors for rotation about parallel axes and at a predetermined spacing from each other to define between them a throat;

each said rotor carrying a plurality of radially projecting longitudinally extending impactors, the impactors of each rotor being angularly spaced apart providing clearance therebetween;

drive means connected to rotate said rotors in timed synchronous fashion but in opposite directions so that the impactors of the opposed rotors pass in pairs through said throat at the same time;

wherein said drive means is adapted to apply a driving torque to each end of both of said rotors and comprises a pair of flexible toothed belts of reinforced rubber composition which cooperate with toothed pinions carried at the respective ends of each said rotor; and means for directing rock into said throat to be crushed and passed through said throat by said rotating impactors.

29. A rock crusher as claimed in claim 28 in combination with a vehicle that includes lifting means for lifting surface material including rocks from the surface of a field, and separating means for separating said rocks and delivering them to said rock crusher.

30. A rock crusher comprising:

a frame;

bearing means carried in said frame and mounting a pair of rotors for rotation about parallel axes and at a predetermined spacing from each other to define between them a throat that has a width and a length;

each said rotor carrying a plurality of radially projecting longitudinally extending impactors, said impactors having a longitudinal extent equal to at least a major part of the length of said throat, the impactors of each rotor being angularly spaced apart providing clearance therebetween;

drive means connected to rotate said rotors in timed synchronous fashion but in opposite directions, the impactors of the opposed rotors being in register so as to pass simultaneously in pairs through a plane in said throat that extends along said axes of said rotors; and a passage for directing rock into said throat to be fractured by said rotating impactors into fragments of a size sufficiently small to pass between said rotors.

* * * * *

UNITED STATES PATENT AND TRADEMARK OFFICE

CERTIFICATE OF CORRECTION

PATENT NO. : 5,697,562

DATED : December 16, 1997

INVENTOR(S) : M. LeBLOND

It is certified that error appears in the above-indentified patent and that said Letters Patent is hereby corrected as shown below:

column 2, line 26, delete "on" and insert --in a plane normal to--.

column 2, line 32, delete "impact or" and insert --impactor--.

column 3, line 10, delete "FIG. 3" and insert --FIG. 2--.

column 3, line 30, delete "impact" and insert --impactor--.

column 5, line 35, delete "compactor" and insert --impactor--.

column 8, line 44,
(claim 19, line 2) delete "impact or" and insert --impactor--.

Signed and Sealed this

Eighteenth Day of August, 1998

Bruce Lehman

*Attest:*

BRUCE LEHMAN

*Attesting Officer*

*Commissioner of Patents and Trademarks*